US010745156B2

(12) United States Patent
Hendriks

(10) Patent No.: US 10,745,156 B2
(45) Date of Patent: Aug. 18, 2020

(54) APPARATUS FOR BANDING PRODUCTS

(71) Applicant: BANDALL PRODUCTIE B.V., Heemskerk (NL)

(72) Inventor: Henk Hendriks, Heemskerk (NL)

(73) Assignee: BANDALL PRODUCTIE B.V., Heemskerk (NL)

( * ) Notice: Subject to any disclaimer, the term of this patent is extended or adjusted under 35 U.S.C. 154(b) by 235 days.

(21) Appl. No.: 15/764,133

(22) PCT Filed: Oct. 7, 2016

(86) PCT No.: PCT/NL2016/050694
§ 371 (c)(1),
(2) Date: Mar. 28, 2018

(87) PCT Pub. No.: WO2017/061867
PCT Pub. Date: Apr. 13, 2017

(65) Prior Publication Data

US 2019/0055039 A1 Feb. 21, 2019

(30) Foreign Application Priority Data

Oct. 8, 2015 (NL) ..... 2015589

(51) Int. Cl.

| | |
|---|---|
| ***B65B 13/06*** | (2006.01) |
| ***B65B 13/18*** | (2006.01) |
| ***B65H 27/00*** | (2006.01) |
| ***B65B 13/22*** | (2006.01) |

(52) U.S. Cl.
CPC ..... *B65B 13/06* (2013.01); *B65B 13/184* (2013.01); *B65B 13/22* (2013.01); *B65H 27/00* (2013.01); *B65H 2404/2611* (2013.01)

(58) Field of Classification Search
CPC ..... B65B 13/04; B65B 13/08; B65B 13/06; B65B 13/184; B65B 13/187; B65B 13/18; B65B 13/22; B65H 27/00; B65H 2404/2611
USPC ..... 100/26, 29, 32, 34
See application file for complete search history.

(56) References Cited

U.S. PATENT DOCUMENTS

| | | | | |
|---|---|---|---|---|
| 3,327,618 A * | 6/1967 | Cook | ..... | B65B 13/02 100/4 |
| 4,444,097 A * | 4/1984 | Wehr | ..... | B65B 13/22 100/32 |
| 4,691,498 A * | 9/1987 | Stamm | ..... | B65B 13/22 100/32 |

(Continued)

FOREIGN PATENT DOCUMENTS

| | | |
|---|---|---|
| EP | 1403184 A1 | 3/2004 |
| EP | 2484612 A1 | 8/2012 |

OTHER PUBLICATIONS

PCT International Search Report and Written Opinion for PCT/NL2016/050694 dated Jan. 26, 2017.

*Primary Examiner* — Jimmy T Nguyen

(57) ABSTRACT

A device for banding products includes a supply mechanism for supplying band material from a supply roll, a strap chute for forming a loop in an end portion of the band material around a space for accommodating products, and a cutter for cutting off the end portion and means for closing the loop. The supply mechanism includes conveyors for gripping the band material over part of its length and conveying the same in a guided manner, as well as a motor for driving the conveying means.

12 Claims, 4 Drawing Sheets

(56) References Cited

U.S. PATENT DOCUMENTS

| | | | | |
|---|---|---|---|---|
| 5,722,217 | A * | 3/1998 | Cloud | B65B 9/087<br>53/385.1 |
| 6,041,581 | A * | 3/2000 | Huber | B65B 13/22<br>100/26 |
| 2009/0165960 | A1 * | 7/2009 | Hataya | B65B 13/06<br>156/382 |

* cited by examiner

APPARATUS FOR BANDING PRODUCTS

CROSS-REFERENCE TO RELATED APPLICATIONS

This is a national stage application filed under 35 U.S.C. 371 of pending international application PCT/NL2016/0050694, filed Oct. 7, 2016, which claims priority to Netherlands national patent application NL2015589, filed Oct. 8, 2015 the entirety of which applications are incorporated by reference herein.

BACKGROUND

The present invention relates to a device for banding products, comprising a supply mechanism for supplying band material from a supply roll, means for forming a loop in an end portion of the band material around a space for accommodating products, means for cutting off the end portion and means for closing the loop. Such a device is also known by the name of banding machine.

Banding comprises arranging a wrapper, also called banderole, around one or more products. A banderole is provided for, inter alia, bundling several products, imparting rigidity to one or more products and/or displaying, as an information carrier, information regarding the product. Usually, banding machines form a loop of band material around a product, which loop is subsequently tightened around the banderole.

The banding capacity, i.e. the number of products per unit of time that can be provided with a banderole, of current banding machines usually falls short of requirements. Furthermore, in many cases a banderole is stretched too tightly or not tightly enough around a product.

BRIEF SUMMARY

It is therefore an object of the present invention to provide a banding machine with a significantly higher banding capacity and a higher precision of the band tension to be applied.

In order to achieve that object, the invention provides a device of the kind described in the introduction, which is characterised in that the supply mechanism comprises conveying means for gripping the band material over part of its length and conveying the same in a guided manner, as well as driving means for driving the conveying means. Gripping and conveying the band material in this way and shows that the band material will run true at all times, irrespective of the stiffness and thickness of the band material. This has a very advantageous effect on the acceleration, speed and precision with which band material can be supplied and retracted. Very thin and flexible band material can thus be conveyed forward and backward through the device at a high speed, whilst also the precision with which the banderole is stretched around the product is significantly increased over a large force range. As a result, the banding capacity is significantly increased. Depending on the band material to be used, or on the materials of a band material built up of several layers (also called laminate), banding speeds of up to 10 m/s with banding accelerations of up to 160 $m/s^2$ can be achieved with a flexible band material having a thickness of 20-50 μm. A typical band material is a laminated plastic film.

In a preferred embodiment of the device according to the invention, the conveying means comprise at least two assemblies, which each comprise pulleys and at least one endless conveyor belt to be passed thereover. A special advantage of a supply mechanism consisting of such assemblies is that the diameters of the pulleys can be varied relative to each other, making it possible to realise various transmission ratios. It is noted that the term "conveyor belt" is understood to include, inter alia, a conveyor belt, a conveyor rope or an assembly thereof and the like.

In another preferred embodiment, a length portion of the side of the conveyor belt of a first assembly that faces away from the pulleys is in contact with a length portion of the side of the conveyor belt of the second assembly that faces away from the pulleys via band material to be guided therebetween. Because the conveyor belt of the first assembly and the conveyor belt of the second assembly are in contact with each other over part of their lengths via the band material, the band material is gripped over part of its length. As a result, the band material can be quickly and precisely supplied and retracted, making it possible to arrange the banderole with great precision and at a high speed over a large tension range, irrespective of the thickness and stiffness of the band material. This is not possible with a pressure roller as generally used in current banding machines.

In another preferred embodiment, the length portions are in contact with each other at the location of a pulley, such that the curvature of the pulley defines a curved contact surface between the length portions of the conveyor belts. As a result, band material is gripped over a curved contact area. A special advantage of this is that, viewed in the conveying direction of the band material, the band material, after being gripped, will be substantially in line with the band material before it is gripped. In this way, the band material is prevented from running off, sloughing up and the like effects. It is noted that the curvature of the curved contact surface preferably follows the circumference of a part of a circle.

In another preferred embodiment, the conveyor belts move forward at the same angular speed at the location of the contact surface. Because of the same angular speed of the conveyor belts at the location of the contact surface, effects such as sloughing and running off of the band material and the like are prevented.

In another preferred embodiment, at least part of the conveyor belt surface that faces away from the pulley is rough. A rough surface increases the frictional resistance between the conveyor belt and the band material and thus prevents the conveyor belt and the band material from moving relative to each other, which is also referred to as slip. The magnitude of the frictional resistance determines the maximum acceleration with which the conveyor belt can be driven without any slip worth mentioning occurring. A high frictional resistance allows a high acceleration, which makes it possible to convey band material forward and backward at a high speed.

In another preferred embodiment, at least part of the outer surface of at least one pulley and/or the surface that faces the pulley of the conveyor belt of at least one assembly is rough. Such a rough surface increases the frictional resistance between the pulley and the conveyor belt and thus prevents the pulley and the conveyor belt from moving relative to each other. Analogous to the above-described effect of an increased frictional resistance between the conveyor belt and the band material, this allows a high acceleration, making it possible to convey band material forward and backward at a high speed.

In a further preferred embodiment, the pulleys are externally toothed, and the conveyor belts comprise toothed (on one side) endless belts for engaging the pulleys. A special advantage of this aspect is that the acceleration to be imparted to the pulley can be transmitted to the conveyor belt over a large acceleration range substantially without slip.

In another preferred embodiment, the conveyor belts are made of an elastic material, preferably rubber. An elastically deformable conveyor belt has this special advantage that it can be kept tensioned on the pulleys during prolonged use, possibly by means of so-called tension pulleys.

According to another preferred embodiment, at least one pulley or at least one pulley of each assembly is driven and the axes of rotation of the pulleys preferably extend substantially parallel to each other and/or the circular centre planes of the pulleys lie substantially in one and the same flat plane. It is noted that if conveyor ropes are used, the orientation and the position of the pulleys are less important, since the conveyor ropes can have any orientation relative to each other for realising the desired gripping and guiding effect.

BRIEF DESCRIPTION OF THE DRAWINGS

The invention will now be explained in more detail with reference to figures illustrated in a drawing, in which.

DETAILED DESCRIPTION

Figure 1:
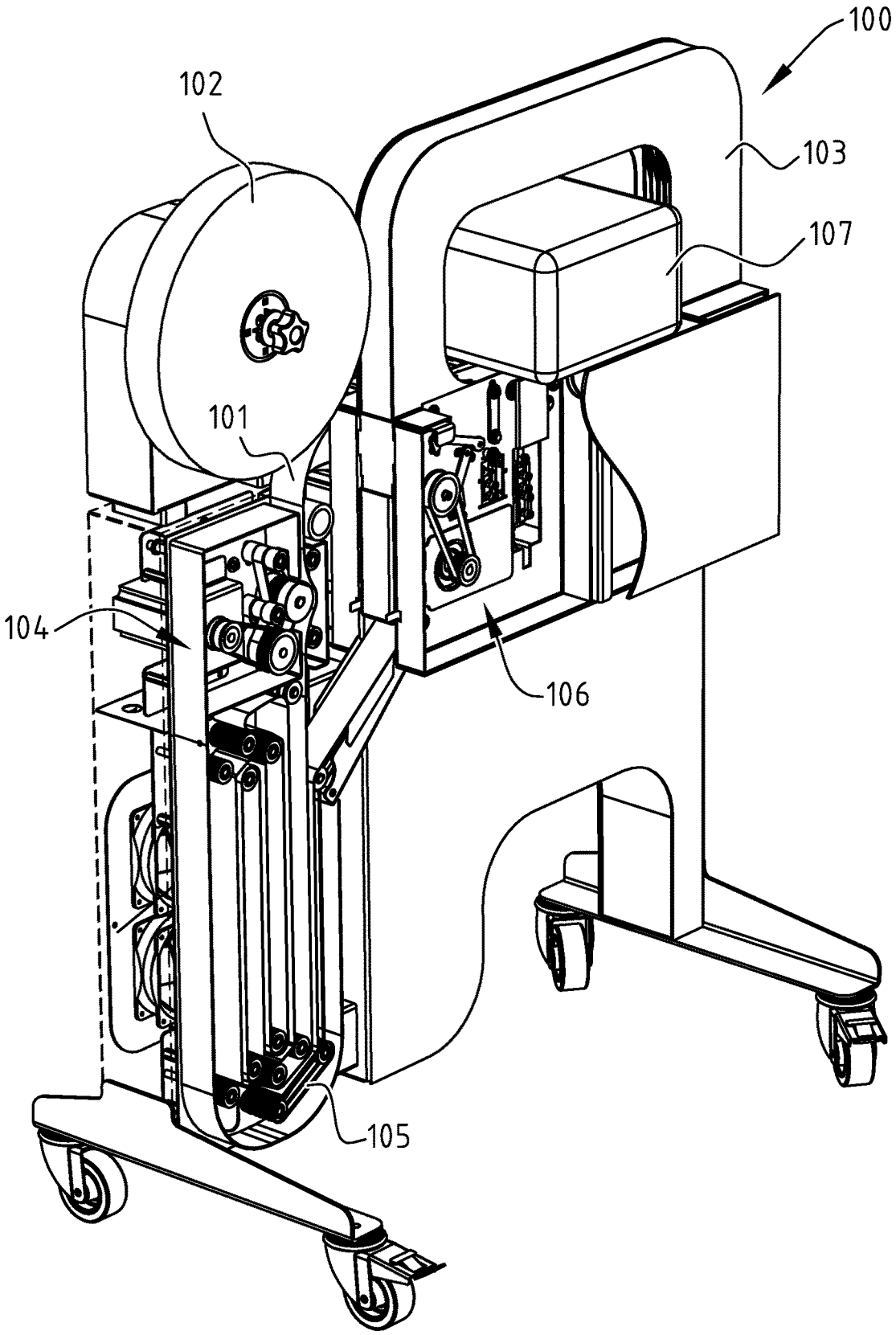
FIG. 1 is a perspective view of a banding machine in a preferred embodiment of the invention.

FIG. 1 shows a perspective view of a banding machine 100. Such a banding machine carries band material 101 from a supply roll 102 through the machine to wrapping means 103. In its path to the wrapping means 103, the band material 101 is successively carried through a first supply mechanism 104, passed over a set of conveyor ropes 105 and carried to the wrapping means 103 via a second supply mechanism 106. The wrapping means 103 subsequently form a loop of band material 101 about a product 107 to be banded. Finally, the loop of band material 101 is closed under the product 107, for example using an adhesive bond, and the closed loop is cut loose from the upstream band material 101 by cutting means. It is noted that in the illustrated embodiment the second supply mechanism 106 is capable of conveying the band material 101 in two opposite directions, so that the band material 101 can be retracted for tightening the loop of band material 101 around the product 107 to be banded before closing of the loop takes place.

Figure 2:
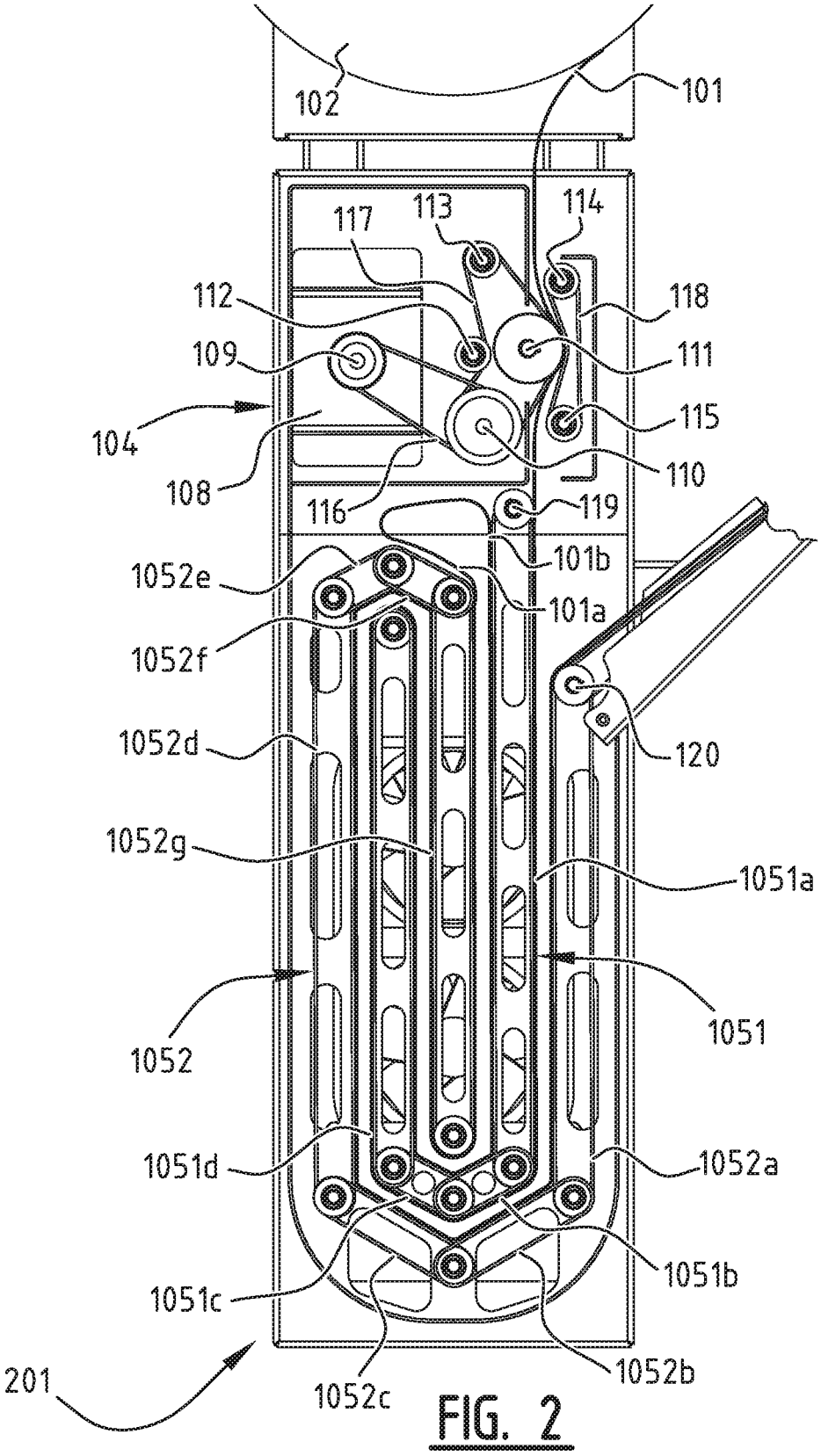
FIG. 2 is a cross-sectional view of a part of the banding machine of FIG. 1.

FIG. 2 shows a cross-sectional view of a part of the banding machine 100, in which the path of the band material 101 through the first supply mechanism 104 and over the set of conveyor ropes 105 toward the second supply mechanism is shown. FIG. 2 further shows parts of the first supply mechanism 104, consisting of an electric motor 108, gears 109, 110 and 111, tension pulleys 112, 113, 114 and 115 and conveyor belts 116, 117 and 118. The manner in which these parts cooperate will be explained in more detail with reference to FIG. 3. FIG. 2 also shows that the set of conveyor ropes 105 consists of two main sets of conveyor ropes 1051 and 1052, which are each driven by separate electric motors via driven pulleys 119 and 120. The main set 1051 comprises 4 sets of conveyor ropes 1051*a*, 1051*b*, 1051*c* and 1051*d*. The main set 1052 in turn comprises 7 sets of conveyor ropes 1052*a*, 1052*b*, 1052*c*, 1052*d*, 1052*e*, 1052*f* and 1052*g*. In this way the two main sets 1051 and 1052 form a buffer mechanism 201, which conveys each of the legs 101*a* and 101*b* of a free loop of the band material 101 at an individual speed. As a result, the speed at which band material 101 is unwound from the supply roll 102 is unlinked from the speed at which band material 101 is arranged around a product 107 by the wrapping means 103. At the same time, the conveyor ropes 1052 of the second set are movable in two opposite directions, so that the band material 101 can be retracted in cooperation with the second supply mechanism 106 for being stretched around the product 107.

Figure 3:
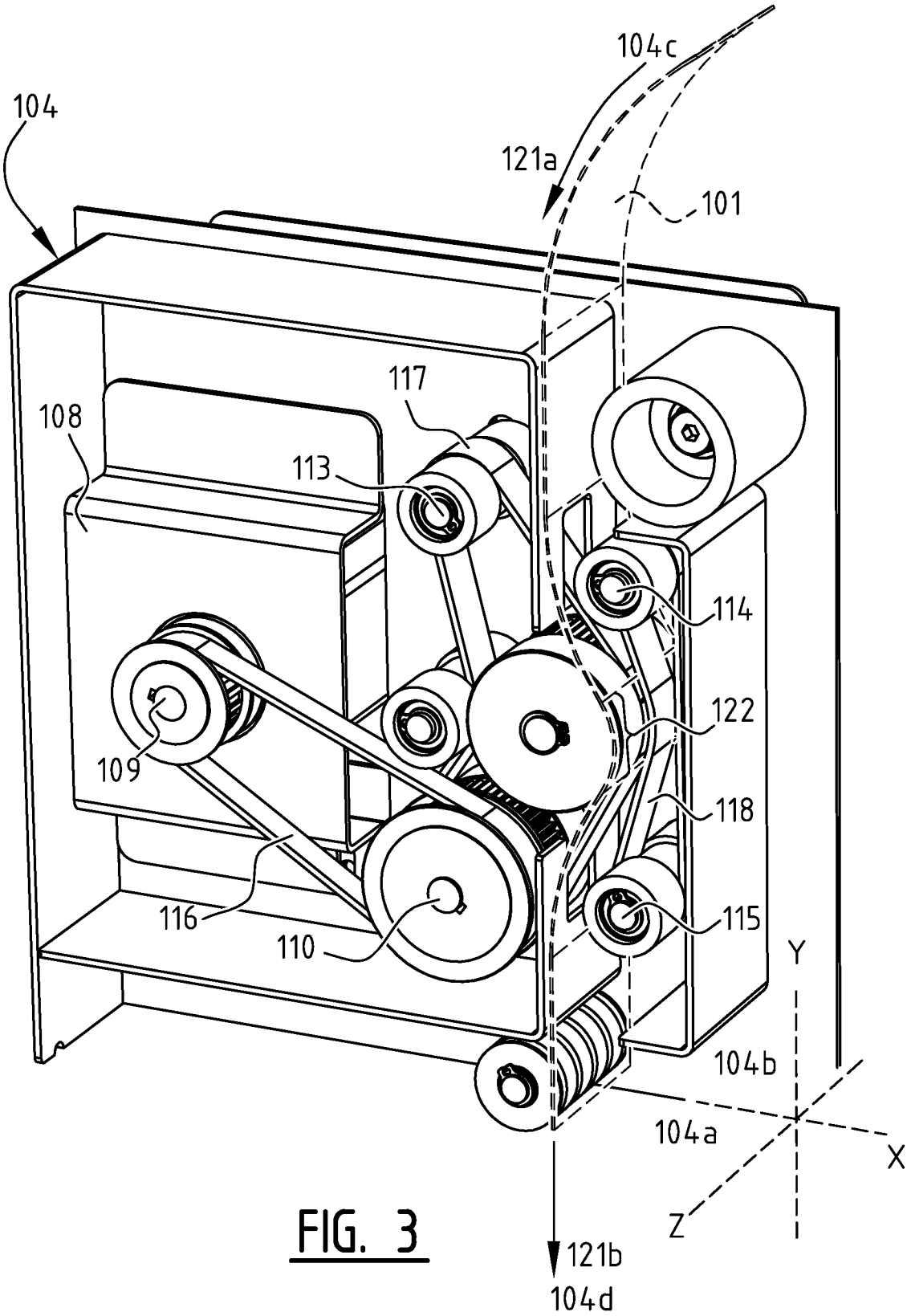
FIG. 3 is a perspective view of a first supply mechanism in the banding machine of FIG. 1.

FIG. 3 shows a perspective view of a front side 104*a* of the first supply mechanism 104. During use of the banding machine 100, the band material 101 coming from the supply roll 102 is conveyed in conveying directions 121*a* and 121*b* as indicated by arrows from an entry side 104*c*, through the first supply mechanism 104, to an exit side 104*d*. Referring to FIGS. 1 a 2, the supply roll 102 is therefore located at the entry side 104*c*, and the set of conveyor ropes 105 is located at the exit side 104*d*. The transport takes place as follows: an electric motor 108 drives an externally toothed gear 109, causing the gear 109 to rotate about its axis of rotation. The gear 109 is connected to a (likewise externally toothed) gear 110 via a toothed (on one side) endless conveyor belt 116. The gear 110 subsequently causes the gear 111 to rotate about its axis of rotation via a second toothed (on one side) endless conveyor belt 117 that passes over the gears 110 and 111, being tensioned by tension pulleys 112 and 113. Viewed in relation to the axis of rotation of the gear 111, tension pulleys 114 and 115 are present on either side of the toothed edge of the gear 111. A conveyor belt 118 passes over said tension pulleys 114 and 115, wherein the central axis of the conveyor belt 118, which points in the direction of movement of the conveyor belt 118, extends substantially parallel to that of the conveyor belt 117, being located at substantially the same height z as that of the conveyor belt 117. Because the tension pulleys 114 and 115 are located on either side of the edge of the gear 111, and the conveyor belts 117 and 118 are oriented in this manner relative to each other, the conveyor belts 117 and 118 are in contact with each other over part of their lengths via the band material 101 to be conveyed therebetween, defining a curved contact surface 122 between their length portions at the location of the gear 111. As a result, the band material 101 is gripped over the area of the curved contact surface 122. This has the advantage that the conveying directions 121*a* and 121*b* of the band material 101 upstream of the gripping area and the band material 101 downstream of the gripping area are in line with each other. This makes it possible not only to convey the band material quickly without any undesirable running off effects, but also to control the amount of band material that is to be conveyed with a high degree of precision. In the illustrated embodiment, the gear 111, like the gears 109 and 110, is circular in shape, so that the curvature of the curved contact surface 122 will follow the circumference of a part of the circle. By realising sufficient friction between the band material 101 and the conveyor belts 117 and 118, the conveyor belts 117 and 118 will move forward at the same angular speed at the location of the curved contact surface 122, so that effects such as running off, sloughing and the like that frequently occur in current banding machines, are prevented. It is noted that the tension pulleys 112, 113, 114 and 115 all perform their tensioning function on the conveyor belts 117 and 118 by means of spring mechanisms provided at the rear side 104*b* of the first supply mechanism 104.

Figure 4:
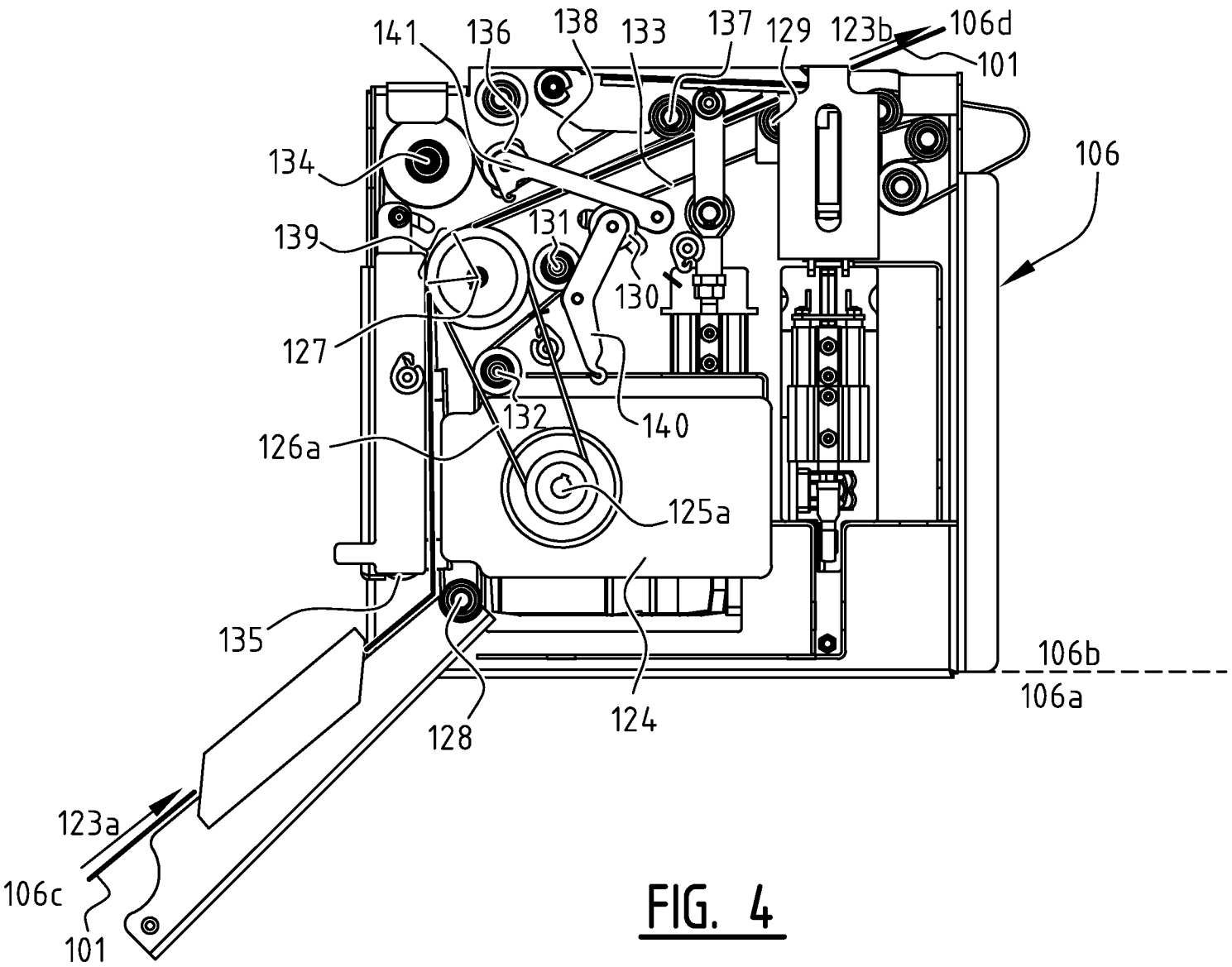
FIG. 4 is a perspective view of a second supply mechanism in the banding machine of FIG. 1.

FIG. 4 shows a perspective view of the second supply mechanism 106. This second supply mechanism 106 mainly consists of an electric motor 124 and two externally toothed gears provided directly on the electric motor 124, one gear 125*a* of which is located at the front side 106*a* of the second supply mechanism 106 and the other gear (not shown) of which is provided on the electric motor 124 at the rear side 106*b* of the second supply mechanism 106. The gears 125*a* (and another not shown) drive two assemblies of gears, tension pulleys and conveyor belts via conveyor belts 126*a* (and another not shown), respectively, the first assembly consisting of a gear 127, five tension pulleys 128, 129, 130, 131 and 132 and a conveyor belt 133, and the second assembly consisting of a gear 134, three tension pulleys 135, 136 and 137 and a conveyor belt 138. During use of the banding machine 100, the band material 101 coming from the set of conveyor ropes 105 is conveyed in conveying directions 123*a* and 123*b* as indicated by arrows from an entry side 106*c*, through the second supply mechanism 106, to an exit side 106*d*. Referring to FIGS. 1 a 2, the set of conveyor ropes 105 is located at the entry side 106*c*, and the wrapping means 103 are located at the exit side 106*d*. The transport of band material 101 takes place as follows: the electric motor 108 drives an externally toothed gear 125*a*, causing the gear 125*a* to rotate about its axis of rotation during operation. The gear 125*a* is connected to a (likewise externally toothed) gear 127 via a toothed (on one side) endless conveyor belt 126*a*, as a result of which the gear 127 rotates about its axis of rotation during operation. The gear 127 subsequently causes the conveyor belt 133 to move forward over the tension pulleys 128, 129, 130, 131 and 132. The gear (not shown) at the rear side 106*b* of the second supply mechanism 106 is connected with a (likewise externally toothed) gear 134 by means of the toothed (on one side) endless conveyor belt (not shown), so that the gear 134 will rotate about its axis of rotation during operation. The gear 134 subsequently causes the conveyor belt 138 to move forward over tension pulleys 135, 136 and 137. The central axis of the conveyor belt 133, which points in the direction of movement of the conveyor belt 33, extends substantially parallel to that of the conveyor belt 138, being located at substantially the same height z as that of the conveyor belt 138. Because the tension pulleys 135 and 136 are located on either side of the edge of the gear 127, and the conveyor belts 133 and 138 are oriented in this manner relative to each other, the conveyor belts 133 and 138 are in contact with each other over part of their lengths via the band material 101 to be conveyed therebetween, defining a curved contact surface 139 between their length portions at the location of the gear 127. As a result, the band material 101 is gripped over the area of the curved contact surface 139. This has the advantage that the conveying directions 123*a* and 123*b* of the band material 101 upstream of the gripping area and the band material 101 downstream of the gripping area are in line with each other. This makes it possible not only to convey the band material quickly without any undesirable running off effects, but also to control the amount of band material that is to be conveyed with a high degree of precision. This enhances on the one hand the banding capacity and on the other hand the precision with which a certain amount of band material can be retracted, resulting in a high precision over a large force area with which the band material can be stretched around the product. In the illustrated embodiment, the gear 127 is circular in shape, so that the curvature of the curved contact surface 139 will follow the circumference of a part of the circle. By realising sufficient friction between the band material 101 and the conveyor belts 133 and 138, the conveyor belts 133 and 138 will move forward at the same angular speed at the location of the curved contact surface 139, so that effects such as running off, sloughing and the like that frequently occur in current banding machines, are prevented. FIG. 4 further shows that the tension pulleys 130 and 136 performed their tensioning function on the conveyor belts 133 and 138 by means of spring mechanisms provided either at the front side 106*a* or at the rear side 106*b* of the second supply mechanism 106.

The invention is not limited to the embodiment shown herein, but it also extends to other preferred variants that fall within the scope of the appended claims.

The invention claimed is:

1. A device for banding products, comprising:

a supply mechanism for supplying band material from a supply roll, means for forming a loop in an end portion of the band material around a space for accommodating products, and a cutter for cutting off the end portion and a sealer for closing the loop, wherein the supply mechanism comprises conveying means for gripping the band material over part of its length and conveying the same in a guided manner, as well as driving means for driving the conveying means;

wherein the conveying means comprise at least two assemblies, which each of said at least two assemblies comprise pulleys and at least one endless conveyor belt to be passed thereover;

wherein the at least two assemblies comprise a first assembly and a second assembly, and a length portion of a side of the conveyor belt of the first assembly that faces away from the pulleys is in contact with a length portion of a side of the conveyor belt of the second assembly that faces away from the pulleys via band material to be guided therebetween;

wherein the length portions are in contact with each other at a location of one of said pulleys, such that a curvature of the pulley defines a curved contact surface between the length portions of the conveyor belts; and wherein one of the pulleys is driven.

2. The device according to claim 1, wherein the conveyor belts move forward at a same angular speed at the location of the contact therebetween.

3. The device according to claim 1, wherein at least part of a surface of the conveyor belt that faces away from the pulley is rough.

4. The device according to claim 1, wherein at least part of an outer surface of at least one pulley of at least one assembly of the conveying means is rough; and wherein at least part of a surface that faces the pulleys, of the conveyor belt of said at least one assembly of the conveying means, is rough.

5. The device according to claim 1, wherein the pulleys are externally toothed, and wherein the conveyor belts comprise toothed endless belts for engaging the pulleys.

6. The device according to claim 1, wherein the conveyor belts are made of an elastic material.

7. The device according to claim 1, wherein at least one of said pulleys of each said assembly is driven.

8. The device according to claim 1, wherein axes of rotation of said pulleys extend parallel to each other.

9. The device according to claim 1, wherein circular centre planes of said pulleys lie in a same flat plane.

10. The device according to claim 1, wherein at least part of an outer surface of at least one pulley of at least one assembly of the conveying means is rough; or wherein a surface that faces the pulleys, of the conveyor belt of said at least one assembly of the conveying means, is rough.

11. The device according to claim 5, wherein the toothed endless belts are toothed on one side.

12. The device according to claim 6, wherein the elastic material is rubber.

* * * * *